US009175928B1

(12) United States Patent
Johnson

(10) Patent No.: US 9,175,928 B1
(45) Date of Patent: Nov. 3, 2015

(54) SIGHT RING WITH MULTIPLE CONCENTRIC ANNULAR VISUALLY CONTRASTING AREAS

(71) Applicant: Cabe M. Johnson, Harrisburg, OR (US)

(72) Inventor: Cabe M. Johnson, Harrisburg, OR (US)

( * ) Notice: Subject to any disclaimer, the term of this patent is extended or adjusted under 35 U.S.C. 154(b) by 200 days.

(21) Appl. No.: 13/843,702

(22) Filed: Mar. 15, 2013

(51) Int. Cl.

| | |
|---|---|
| ***F41G 1/00*** | (2006.01) |
| ***F41G 1/467*** | (2006.01) |
| *F41B 5/00* | (2006.01) |
| *F41B 5/14* | (2006.01) |
| *F41G 1/30* | (2006.01) |
| *F41G 1/34* | (2006.01) |
| *F41G 1/473* | (2006.01) |

(52) U.S. Cl.
CPC . *F41G 1/467* (2013.01); *F41B 5/14* (2013.01); *F41G 1/30* (2013.01); *F41G 1/345* (2013.01); *F41G 1/473* (2013.01)

(58) Field of Classification Search
CPC ..... F41G 1/467; F41G 1/345; F41G 1/473; F41G 1/30; F41B 5/14
USPC ..... 33/265; 124/87
See application file for complete search history.

(56) References Cited

PUBLICATIONS

ArcheryTalk.com. "Vital Bow Gear Triangle Sight w/Pin Guard and Glow Ring, 3 Pin .029, RH 27.00 TYD". ArcheryTalk Forums [online]. Jul. 13, 2010; 09:23 [retrieved on Jan. 13, 2015]. Retrieved from the Internet: <URL: http://www.archerytalk.com/vb/showthread.php?t=1259431>.*

Larsen, Michael. "Review: HHA Optimizer Lite Sights". ArcheryReport.com. Oct. 14, 2011 [retrieved on Jan. 13, 2015]. Retrieved from the Internet: <URL: http://web.archive.org/web/20111014075829/http://archeryreport.com/2011/02/review-hha-optimizer-lite-sights/>.*

ArcheryReport.com. "How to: Properly Size a Peep Sight". Aug. 6, 2012 [retrieved on Jan. 13, 2015]. Retrieved from the Internet: <http://web.archive.org/web/20120806002334/http://archeryreport.com/2012/04/properly-size-peep-sight>.*

* cited by examiner

*Primary Examiner* — Laura Martin
*Assistant Examiner* — Rhyan C Lange
(74) *Attorney, Agent, or Firm* — David S. Alavi

(57) ABSTRACT

An archery sight includes an annular sight ring, one or more sight pins, and a set of two or more nested, annular, substantially concentric, visually contrasting areas on a rearward surface of the sight ring arranged substantially concentrically relative to the sight ring. One or more of the sight pins are visible through a central opening of an innermost annular colored area. With the bow held at full draw, the peep aperture and the central axis of the sight ring are substantially aligned along an intended sight line for the bow. Respective diameters of the peep aperture and the annular contrasting areas result, with an archer looking through the peep aperture along the intended sight line, in an observed image of a substantially circular border of at least one of the annular contrasting areas substantially coinciding with an observed image of the peep aperture.

12 Claims, 4 Drawing Sheets

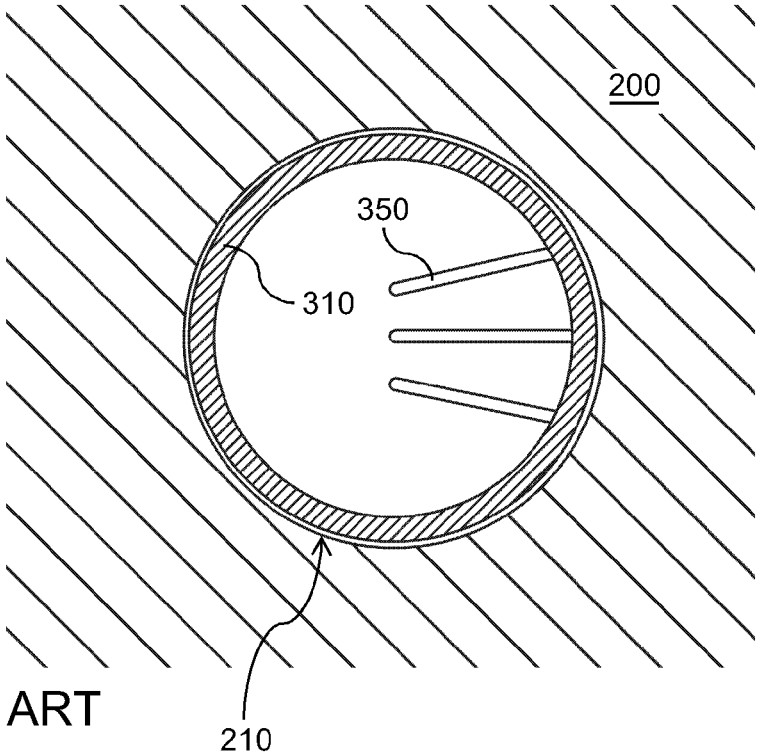
FIG. 2
PRIOR ART
FIG. 3
PRIOR ART
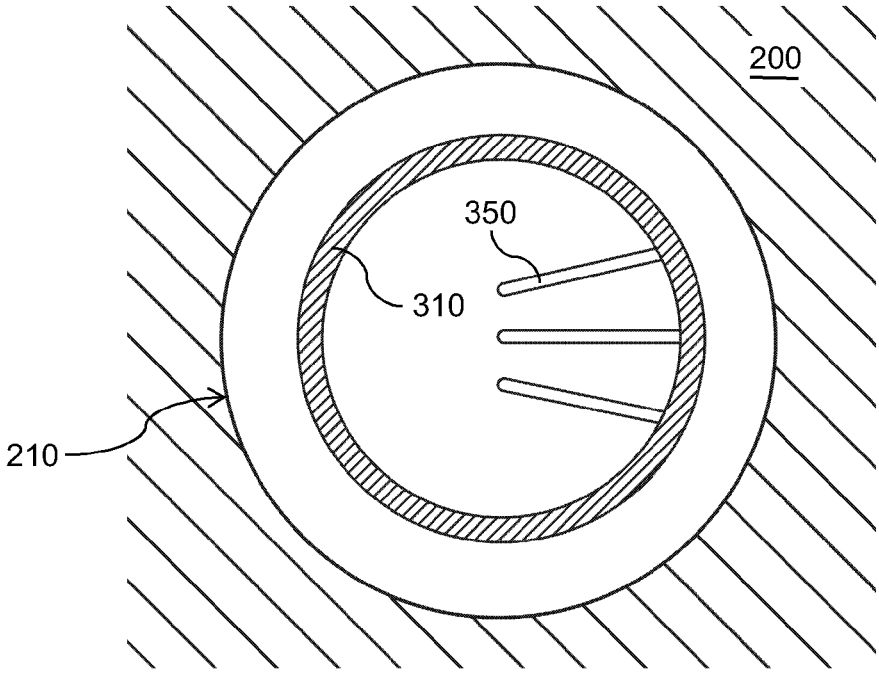

SIGHT RING WITH MULTIPLE CONCENTRIC ANNULAR VISUALLY CONTRASTING AREAS

BACKGROUND

The field of the present invention relates to archery sights. In particular, a sight ring with multiple nested concentric annular high-contrast colored areas is disclosed for enabling an archer to align the sight under differing lighting conditions.

A common arrangement employed in archery bows includes a sight 300 mounted at the front of the bow that includes one or more sight pins 350 arranged within a sight ring 310 (FIG. 1), and a so-called peep sight inserted into the bowstring. The peep sight is inserted into the bowstring at a position that places it in front of the archer's eye when the bow is held at full draw. The archer aims the bow by looking through the peep sight and through the sight ring 310 and aligning one of the sight pins 350 on the intended target. The distance from the archer's eye to the peep sight typically is in the range of 1 to 4 inches and often in the range of 2 to 3 inches. The distance from the peep sight to the sight ring 310 (with the bow held at full draw) typically is between 26 and 36 inches and often in the range of 30 to 32 inches. The diameter of the sight ring 310 typically is in the range of 2 to 3½ inches and often in the range of 2 to 2½ inches. The peep sight typically comprises a disk or ring with a small axial aperture. Typical sizes of the aperture of commonly available peep sights include 1/16 inch, 1/8 inch, and 3/16 inch; other sizes may also be available from manufacturers.

The arrangement of the peep sight and the sight ring with sight pins constitutes a so-called aperture sight. When looking through the aperture of the peep sight, the archer centers an image of the sight ring 310 within an image of the aperture 210 of the peep sight 200, thus properly aligning his line of sight and enabling him to aim the bow by then aligning a sight pin 350 (within the sight ring) on the target (FIG. 2). The aperture 210 of the peep sight 200 limits the archer's field of view and typically presents an unfocused, diffuse edge when the archer's vision is focused on the sight ring 310 or on the target.

SUMMARY

An archery bow includes a riser, limbs, a bowstring, a sight, and a peep sight mounted on the bowstring; the peep sight includes a peep aperture. The sight includes (i) an annular sight ring having a central opening that extends axially through the ring, (ii) one or more sight pins positioned within the central opening of the sight ring, (iii) a mounting bracket arranged to mount the sight ring on the bow with a central axis of the annular sight ring in a fore-and-aft orientation relative to the bow, and (iv) a set of two or more nested, annular, substantially concentric, visually contrasting areas on a rearward surface of the sight ring arranged substantially concentrically relative to the sight ring. One or more of the sight pins are visible to the archer looking though a central opening of an innermost one of the annular contrasting areas. The bow is arranged so that, when held at full draw, the peep aperture and the central axis of the sight ring are substantially aligned along an intended sight line for the bow. Respective diameters of the peep aperture and the annular contrasting areas result, with an archer looking through the peep aperture along the intended sight line, in an observed image of a substantially circular border of at least one of the annular contrasting areas substantially coinciding with an observed image of the peep aperture.

Objects and advantages pertaining to archery bow sights may become apparent upon referring to the exemplary embodiments illustrated in the drawings and disclosed in the following written description or appended claims.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

FIG. 2 illustrates schematically an optimal view through a peep aperture and a conventional sight ring.

FIG. 3 illustrates schematically a non-optimal view through a peep aperture and a conventional sight ring.

It should be noted that the embodiments depicted in this disclosure are shown only schematically, and that not all features may be shown in full detail or in proper proportion. Certain features or structures may be exaggerated relative to others for clarity. It should be noted further that the embodiments shown are only examples, and should not be construed as limiting the scope of the written description or appended claims.

DETAILED DESCRIPTION OF EMBODIMENTS

Figure 1:
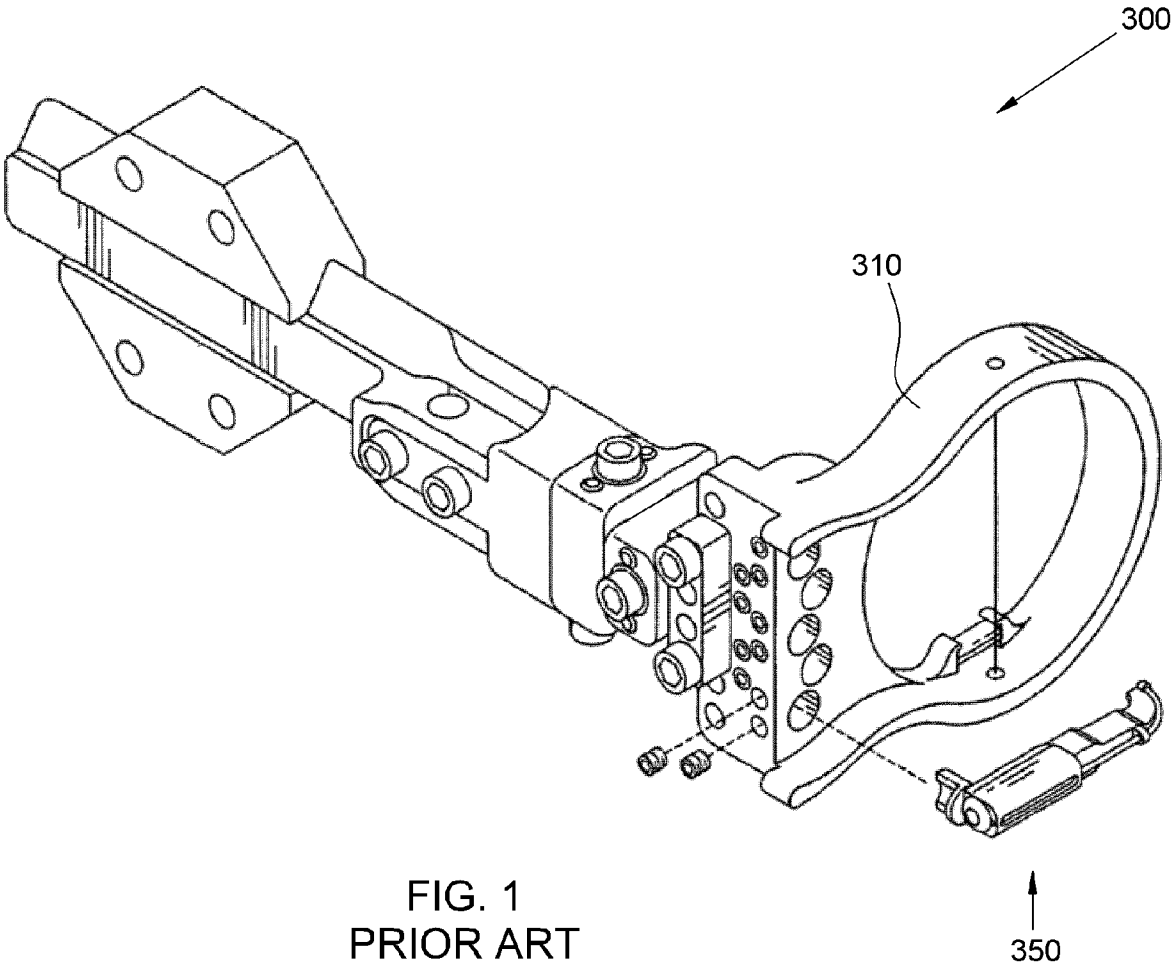
FIG. 1 PRIOR ART
FIG. 1 is a perspective view of an example of a conventional sight for an archery bow.
Figure 4:
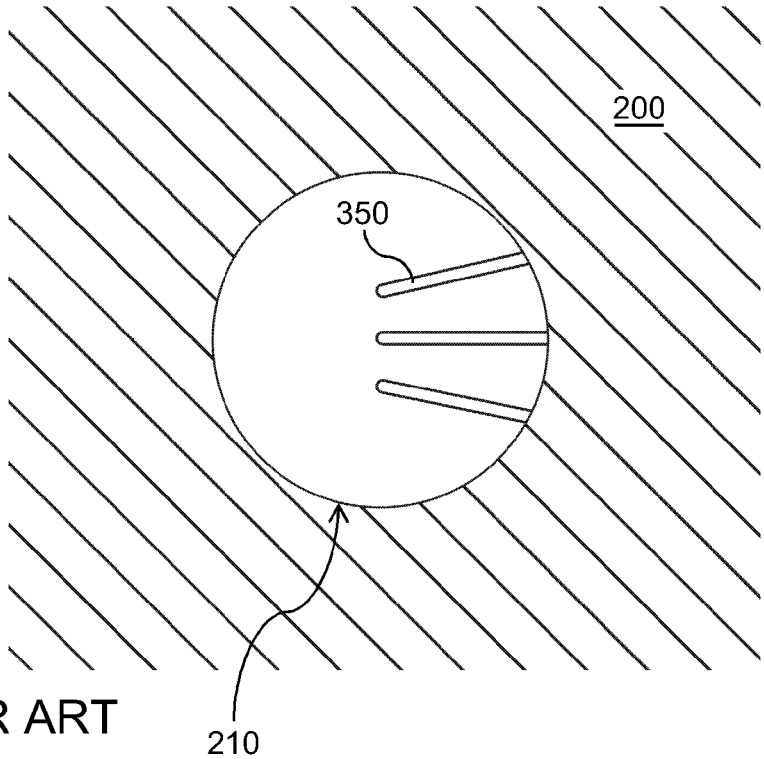
FIG. 4 PRIOR ART
FIG. 4 illustrates schematically another non-optimal view through a peep aperture and a conventional sight ring.

The arrangement of FIG. 2 represents a near ideal situation in which the archer's observed image of the sight ring 310 substantially coincides with his observed image of the peep aperture 210. "Substantially coincides" is not intended to denote precise matching of the images, but instead a range of situations in which (i) the archer's field of vision through the peep aperture 210 is large enough for him to see at least a portion of the sight ring 310 when it is centered on the peep aperture 210, and (ii) the observed image of the sight ring 310 is large enough to enable the archer to readily center the images on one another. An example wherein the image of the sight ring 310 is, e.g., over 90% of the diameter of the image of the peep aperture 210 (as in FIG. 2), would be considered to meet the criterion of those images "substantially coinciding"; an example wherein the sight ring image 310 is only, e.g., about 75% of the peep aperture image 210 (as in FIG. 3), or wherein the sight ring 310 is too large to be seen through the peep aperture 210 when centered (as in FIG. 4), would not be considered "substantially coinciding." The precise transition from "substantially coinciding" to "not substantially coinciding" is subjective and may vary from one archer to another.

The near ideal, "substantially coinciding" arrangement of FIG. 2, alas, does not always occur. Differences among archers' vision and stature (e.g., arm length, nose length), and differences among bows, sights and sight rings, and peep sights can lead to situations in which the images of the sight ring and peep aperture do not substantially coincide for a given archer, bow, and sight. The commercial availability of peep sights with differing peep aperture sizes can partially mitigate the problem by enabling the archer to select a peep aperture size that most nearly achieves substantial coincidence of the images. However, the discrete set of sizes available commercially (e.g., 1/16 inch, 1/8 inch, 3/16 inch) may provide only an approximate solution, but not an optimal match for a given archer, bow, and sight. Archers often customize their peep sights by altering the aperture size, usually by enlarging it with a file, drill, reamer, or other tool. In this way an archer skilled with such tools can achieve an optimal peep aperture.

However, a peep aperture size that is optimal for one archer using the bow may not be suitable for a different archer using that bow. In addition, ambient lighting conditions can also affect the substantial coincidence of the sight ring and peep sight images. An archer's field of view through the peep aperture tends to decrease as ambient light levels increase. A peep aperture that may be optimal for a given archer, bow, and sight outdoors in bright sunlight may be completely unsuitable for that archer, bow, and sight in a dimly lit indoor shooting range.

It would be desirable to develop an apparatus that mitigates the need for an optimized peep aperture size, thereby enabling ready centering of sight ring and peep aperture images by different archers using a given bow, sight, and peep aperture, or by one archer using a given bow, sight, and peep aperture under differing ambient light conditions.

Figure 5:
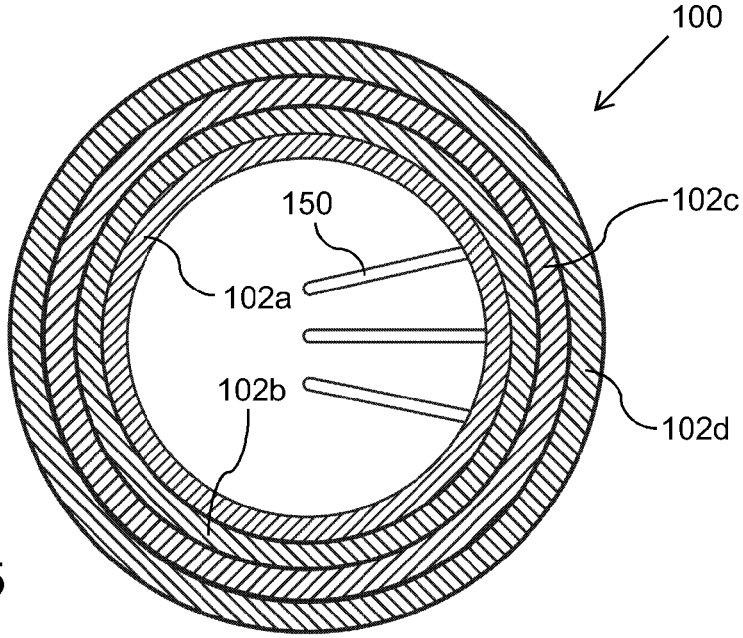
FIG. 5 illustrates schematically an embodiment of a sight ring with a set of nested, annular, substantially concentric, visually contrasting areas.

An apparatus that achieves that desired result comprises: an annular sight ring 100, one or more sight pins 150, a mounting bracket, and two or more visually contrasting areas 102*a*, 102*b*, etc. (i.e., collectively, areas 102) on the sight ring 100 (FIG. 5). The annular sight ring 100 has a central opening that extends axially through the ring. The one or more sight pins 150 are positioned within the central opening of the sight ring 100. The mounting bracket is arranged to mount the sight ring on an archery bow with a central axis of the annular sight ring 100 in a fore-and-aft orientation relative to the bow. The contrasting areas 102 comprise a set of two or more nested, annular, substantially concentric, visually contrasting areas on a rearward surface of the sight ring 100. The annular contrasting areas 102 are arranged substantially concentrically relative to the sight ring 100. One or more sight pins 150 are visible to an archer looking though a central opening of an innermost one 102*a* of the annular contrasting areas 102.

Figure 6:
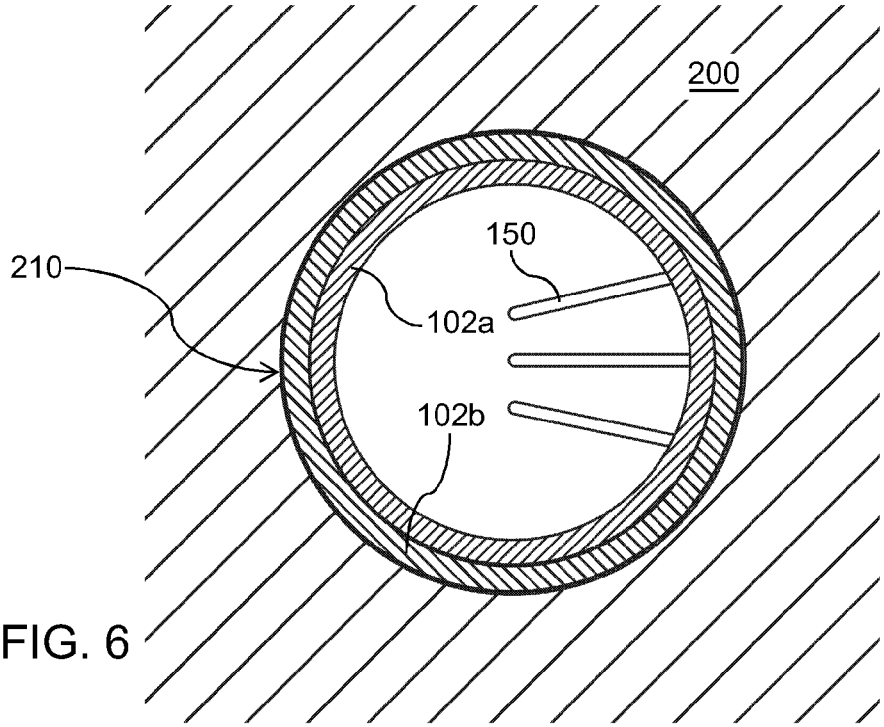
FIG. 6 illustrates schematically a view through a peep aperture and the sight ring of FIG. 5.
Figure 7:
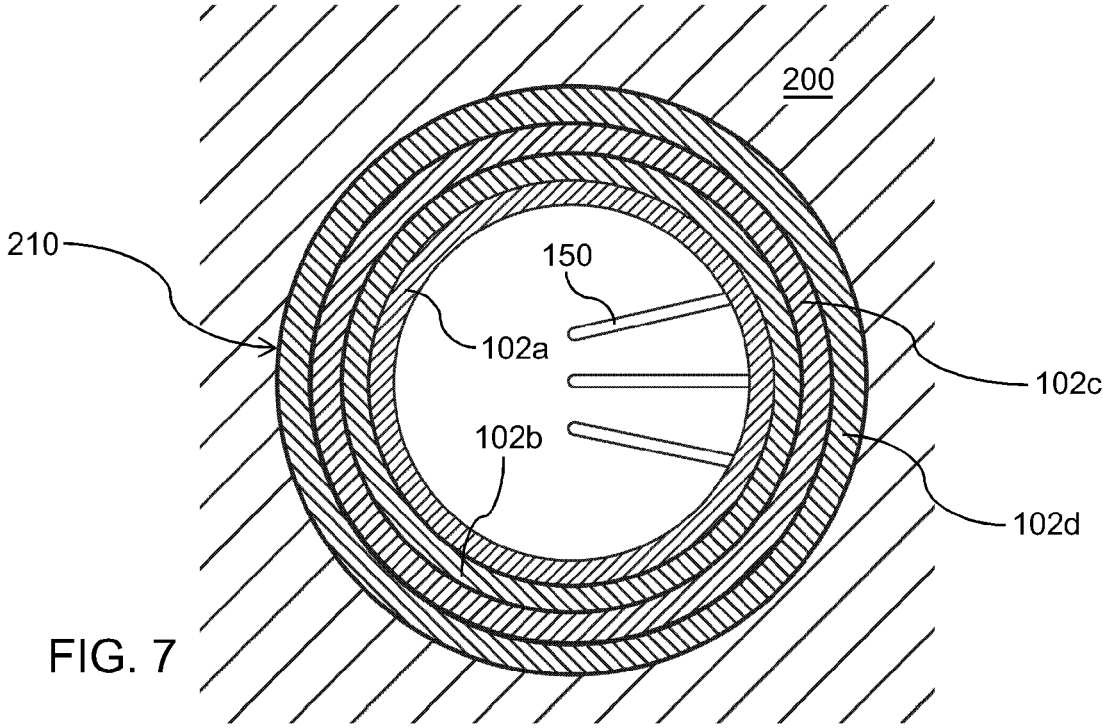
FIG. 7 illustrates schematically another view through a peep aperture and the sight ring of FIG. 5.

The apparatus can further comprise an archery bow including a riser, limbs, a bowstring, and a peep sight 200 (with a peep aperture 210) mounted on the bowstring. As noted above, the bow is arranged so that, when held at full draw, the peep aperture 210 and the central axis of the sight ring 100 are substantially aligned along an intended sight line for the bow. Respective diameters of the peep aperture 210 and the annular contrasting areas 102 result, with an archer looking through the peep aperture 210 along the intended sight line, in an observed image of a substantially circular border of at least one of the annular contrasting areas 102 substantially coinciding with an observed image of the peep aperture 210. Which of the annular contrasting areas 102 has a border with an image substantially coinciding with the image of the peep aperture 210 varies according to peep aperture diameter, eye-to-peep-sight distance, peep-sight-to-sight-ring distance, or ambient light level (FIGS. 6 and 7).

For a given archer under differing ambient light conditions, or for different archers using a given bow, the archer's field of view through the peep aperture 210 changes, as noted above. With only the sight ring available to align with the peep aperture, that field variation can make it difficult to center the images. With the set of concentric, annular contrasting areas 102, however, the archer can center a substantially circular border of at least one area 102 within the peep aperture 210. The range of diameters of those boundaries among the set of annular contrasting areas 102 ensures that an observed image of at least one such border "substantially coincides" with the observed image of the peep aperture 210, regardless of the variation in the field of view through the peep aperture 210. The images can therefore be readily centered under varying ambient light conditions or by different archers.

The annular contrasting areas 102 can be formed on the rearward surface of the sight ring 100 in any suitable way. In one embodiment, a set of annular colored areas 102 comprises a sheet (e.g., a sticker or decal) adhered to the rearward surface of the sight ring 100. Such an arrangement can be employed conveniently to modify an existing sight ring by adding the annular colored areas to it as a retrofit. In such a retrofit scenario, the central opening through the innermost annular colored area 102*a* in some instances might be small enough to obscure some of the sight pins 150. This can be acceptable in some instances as long as at least one sight pin 150 remains visible through the colored areas. A preferred arrangement leaves all of the sight pins 150 visible through the center opening through the innermost annular colored region 102*a*. That preferred arrangement is readily achieved when the sight is manufactured originally to include the annular colored areas, (i.e., not a retrofit). For a sight ring having an outer diameter in the range of about 2 to 3 inches, the central opening through the innermost annular colored area can have a diameter in the range of about 1 to 2½ inches. Other sizes can be suitably employed as needed of desired. In other embodiments, the annular colored areas can be formed, e.g., by applying paint or pigment, etching or anodizing the sight ring material, or other methods.

Any colors can be employed (including black or white), provided that each border provides sufficient visual contrast to enable alignment with the peep aperture. "Sufficient visual contrast" may typically be determined subjectively. The outermost and innermost annular areas should be colored to contrast with the surroundings wherein the bow is used; each annular area should be colored to contrast with adjacent annular areas. One suitable arrangement includes an alternating sequence of two contrasting colors; fluorescent orange and fluorescent yellow are examples of suitable choices for the two colors. However, any color scheme can be employed that enables the archer to visually center at least one of the substantially circular borders with the peep aperture.

While color is one way of achieving visual contrast, other ways can be employed in other embodiments. The annular contrasting areas can differ with respect to reflectivity (magnitude or direction), surface roughness, scattering strength, fluorescence or phosphorescence, brightness, hue, tint, polarization dependence (perhaps in conjunction with polarizing eyewear), or any other suitable visual property.

A set of N nested, substantially concentric annular regions provides N+1 substantially circular borders of varying diameters that might substantially coincide with the peep aperture with the archer looking along the intended sight line. Any suitable number and diameters of those annular areas can be employed. A set of two annular areas provides a choice of three substantially circular borders to choose from, which may be sufficient in many circumstances. A set of three annular areas provides a choice of four such borders to choose from. Larger numbers of annular areas can be employed as needed or desired. The annular areas can all have the same width (i.e., the difference between inner and outer diameters), or the widths can vary among the annular areas in any suitable or desired manner.

In addition to the preceding, the following examples fall within the scope of the present disclosure or appended claims:

Example 1

An apparatus comprising: (a) an annular sight ring having a central opening that extends axially through the ring; (b) one or more sight pins positioned within the central opening of the sight ring; (c) a mounting bracket arranged to mount the sight ring on an archery bow with a central axis of the annular sight ring in a fore-and-aft orientation relative to the bow; and (d) a set of two or more nested, annular, substantially concentric, visually contrasting areas on a rearward surface of the sight ring arranged substantially concentrically relative to the sight ring, (e) wherein one or more of the sight pins are visible to an archer looking though a central opening of an innermost one of the annular contrasting areas.

Example 2

The apparatus of Example 1 wherein the set of annular contrasting areas comprises a set of annular contrasting colored areas.

Example 3

The apparatus of Example 2 wherein the set of annular contrasting colored areas comprises a sheet adhered to the rearward surface of the sight ring.

Example 4

The apparatus of any preceding Example wherein the set of annular contrasting areas includes three or more annular contrasting areas.

Example 5

The apparatus of any preceding Example wherein the set of annular contrasting areas comprise an alternating sequence of two contrasting colors.

Example 6

The apparatus of Example 5 wherein the two contrasting colors are fluorescent orange and fluorescent yellow.

Example 7

The apparatus of any preceding Example further comprising an archery bow including a riser, limbs, a bowstring, and a peep sight mounted on the bowstring, wherein: (f) the peep sight includes a peep aperture; (g) the bow is arranged so that, when held at full draw, the peep aperture and the central axis of the sight ring are substantially aligned along an intended sight line for the bow; and (h) respective diameters of the peep aperture and the annular contrasting areas result, with an archer looking through the peep aperture along the intended sight line, in an observed image of a substantially circular border of at least one of the annular contrasting areas substantially coinciding with an observed image of the peep aperture.

Example 8

The apparatus of Example 7 wherein which of the annular contrasting areas has a border with an image substantially coinciding with the image of the peep aperture varies according to peep aperture diameter, eye-to-peep-sight distance, peep-sight-to-sight-ring distance, or ambient light level.

Example 9

A method performed by an archer using the apparatus of Examples 7 or 8 wherein the method comprises, while holding the bow at full draw, (i) looking through the peep aperture and (ii) centering within the observed image of the peep aperture an observed image of a substantially circular border of at least one of the annular contrasting areas.

It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims.

In the foregoing Detailed Description, various features may be grouped together in several exemplary embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed exemplary embodiment. Thus, the appended claims are hereby incorporated into the Detailed Description, with each claim standing on its own as a separate disclosed embodiment. However, the present disclosure shall also be construed as implicitly disclosing any embodiment having any suitable set of one or more disclosed or claimed features (i.e., sets of features that are not incompatible or mutually exclusive) that appear in the present disclosure or the appended claims, including those sets that may not be explicitly disclosed herein. It should be further noted that the scope of the appended claims do not necessarily encompass the whole of the subject matter disclosed herein.

For purposes of the present disclosure and appended claims, "aligning the sight ring and the peep aperture" or "aligning a circular border of an annular colored area and the peep aperture" or similar phrases denotes aligning the images of those objects in the field of vision of the archer using the bow. For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure or appended claims, the words "comprising," "including," "having," and variants thereof, wherever they appear, shall be construed as open ended terminology, with the same meaning as if the phrase "at least" were appended after each instance thereof.

In the appended claims, if the provisions of 35 USC §112 ¶6 are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112 ¶6 are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. An apparatus comprising:

(a) an archery bow including a riser, limbs, a bowstring, and a peep sight mounted on the bowstring; and (b) an archery sight including a mounting bracket, an annular sight ring, one or more sight pins, and a set of two or more nested, annular, substantially concentric, visually contrasting areas attached to a rearward surface of the sight ring and arranged substantially concentrically relative to the sight ring, wherein:

(c) the annular sight ring has a central opening that extends axially through the ring;

(d) the one or more sight pins are positioned within the central opening of the sight ring;

(e) the mounting bracket is arranged to mount the sight ring on the archery bow with a central axis of the annular sight ring in a fore-and-aft orientation relative to the bow;

(f) the bow is arranged so that, when held at full draw, the peep sight and the central axis of the sight ring are substantially aligned along an intended sight line for the bow;

(g) the peep sight includes a peep aperture, and one or more of the sight pins are visible to an archer looking through the peep aperture and though a central opening of an innermost one of the annular contrasting areas; and (h) respective diameters of the peep aperture and the annular contrasting areas result, with an archer looking through the peep aperture along the intended sight line, in (i) an image observed by the archer of a substantially circular border of a first one of the annular contrasting areas substantially coinciding with an observed image of the peep aperture at a first ambient light level, and (ii) an image observed by the archer of a substantially circular border of a second one of the annular contrasting areas, differing from the first one, substantially coinciding with an observed image of the peep aperture at a second ambient light level differing from the first ambient light level.

2. The apparatus of claim 1 wherein the set of annular contrasting areas comprises a set of annular contrasting colored areas.

3. The apparatus of claim 2 wherein the set of annular contrasting colored areas comprises a sheet adhered to the rearward surface of the sight ring.

4. The apparatus of claim 1 wherein the set of annular contrasting areas includes three or more annular contrasting areas.

5. The apparatus of claim 1 wherein the set of annular contrasting areas comprise an alternating sequence of two contrasting colors.

6. The apparatus of claim 5 wherein the two contrasting colors are fluorescent orange and fluorescent yellow.

7. A method performed by an archer using an archery bow wherein:

(a) the bow includes a riser, limbs, a bowstring, a sight, and a peep sight mounted on the bowstring and the peep sight includes a peep aperture;

(b) the sight includes (i) an annular sight ring having a central opening that extends axially through the ring, (ii) one or more sight pins positioned within the central opening of the sight ring, (iii) a mounting bracket arranged to mount the sight ring on the bow with a central axis of the annular sight ring in a fore-and-aft orientation relative to the bow, and (iv) a set of two or more nested, annular, substantially concentric, visually contrasting areas on a rearward surface of the sight ring arranged substantially concentrically relative to the sight ring;

(c) one or more of the sight pins are visible to the archer looking through the peep aperture and though a central opening of an innermost one of the annular contrasting areas;

(d) the bow is arranged so that, when held at full draw, the peep aperture and the central axis of the sight ring are substantially aligned along an intended sight line for the bow;

(e) respective diameters of the peep aperture and the annular contrasting areas result, with the archer looking through the peep aperture along the intended sight line, in (i) an image observed by the archer of a substantially circular border of a first one of the annular contrasting areas substantially coinciding with an observed image of the peep aperture at a first ambient light level, and (ii) an image observed by the archer of a substantially circular border of a second one of the annular contrasting areas, differing from the first one, substantially coinciding with an observed image of the peep aperture at a second ambient light level differing from the first ambient light level;

(f) at the first ambient light level, the method comprises, while holding the bow at full draw, (i) looking through the peep aperture and (ii) centering within the observed image of the peep aperture the observed image of the substantially circular border of the first one of the annular contrasting areas; and (g) at the second ambient light level, the method further comprises, while holding the bow at full draw, (i) looking through the peep aperture and (ii) centering within the observed image of the peep aperture the observed image of the substantially circular border of the second one of the annular contrasting areas.

8. The method of claim 7 wherein the set of annular contrasting areas comprises a set of annular contrasting colored areas.

9. The method of claim 8 wherein the set of annular contrasting colored areas comprises a sheet adhered to the rearward surface of the sight ring.

10. The method of claim 7 wherein the set of annular contrasting areas includes three or more annular contrasting areas.

11. The method of claim 7 wherein the set of annular contrasting areas comprise an alternating sequence of two contrasting colors.

12. The method of claim 11 wherein the two contrasting colors are fluorescent orange and fluorescent yellow.

* * * * *